US007296408B2

(12) United States Patent
Pierce

(10) Patent No.: US 7,296,408 B2
(45) Date of Patent: Nov. 20, 2007

(54) HEAT ENGINE

(76) Inventor: Michael R. Pierce, 3465 N. Princess Cir., Broomfield, CO (US) 80020

( * ) Notice: Subject to any disclaimer, the term of this patent is extended or adjusted under 35 U.S.C. 154(b) by 240 days.

(21) Appl. No.: 10/946,228

(22) Filed: Sep. 21, 2004

(65) Prior Publication Data

US 2006/0059906 A1 Mar. 23, 2006

(51) Int. Cl.
*F01B 29/10* (2006.01)

(52) U.S. Cl. ..... 60/522; 60/524

(58) Field of Classification Search ..... 60/517, 60/518, 522, 524, 526; 91/396
See application file for complete search history.

(56) References Cited

U.S. PATENT DOCUMENTS 4,230,024 A * 10/1980 Becker ..... 92/13.1
4,918,937 A * 4/1990 Fineblum ..... 62/175
5,061,391 A * 10/1991 Scaringe et al. ..... 252/67
6,062,023 A 5/2000 Kerwin et al.
6,694,731 B2 2/2004 Kamen et al.

OTHER PUBLICATIONS

Ordonez, C.A.; Liquid nitrogen fueled, closed Brayton cycle cryogenic heat engine; Energy Conversion and Management; 2000; pp. 331-341, vol. 41 No. 4; Great Britain.
Chen, N.C.J., & West, C.D.(M); Single-cylinder valveless heat engine; Intersociety Energy Conversion Engineering conference report; Aug. 10-14, 1987; Report #Conf-87080451.

* cited by examiner

*Primary Examiner*—Hoang Nguyen
(74) *Attorney, Agent, or Firm*—Macheledt Bales & Heidmiller, LLP; Jennifer L. Bales

(57) ABSTRACT

The heart of a heat engine is a reciprocating expansion chamber, which converts heat from a hot fluid into mechanical work. The expansion chamber utilizes a refrigerant in a liquid state as an input, and heats and expands the refrigerant to move pistons and generate work. A high pressure injector injects the liquid refrigerant into the chamber under enough pressure to keep it in a liquid state until it is desirable to have it expand into a gas. A hot fluid is the heat source for the expansion chamber and cold fluid is an output. Another output is the refrigerant, now a hot, low pressure gas. A compressor pressurizes the refrigerant, forming a hot, high pressure gas, and a condenser generates liquid refrigerant and provides it to the pressure injector.

20 Claims, 7 Drawing Sheets

HEAT ENGINE

BACKGROUND OF THE INVENTION

1. Field of the Invention

The present invention relates to apparatus and methods for converting heat energy into mechanical energy.

2. Description of the Prior Art

The law of conservation of energy states that energy may be transformed from one kind to another, but it cannot be created or destroyed. Further, energy is defined as the ability to do work. Mechanical energy is more convenient for doing work of most kinds, various apparatus for converting heat energy into mechanical energy have been developed. These are generally called "heat engines."

The steam engine is an engine in which water is superheated to create high pressure steam, that in turn pressurizes a cylinder containing a piston. The pressure causes the displacement of the piston. The axial motion of the piston translates its energy to a crankshaft that rotates as a result of the piston motion. This results in mechanical work.

The steam turbine also utilizes super heated water vapor to generate mechanical work. The high pressure steam in this system applies a force normal to the turbine fins attached to a rotating armature. Hence the applied force results in the armature rotating.

The Stirling engine is a well known heat engine operating in two general modes during a cycle. In the first mode, the expansion cycle heats the internal gas via an external heat source. The gas expands and moves a first piston. In the second mode, the gas is cooled, retracting a second piston. FIG. 1 (prior art) is a simplified block diagram of one type of Stirling engine 100. Like any heat engine it requires a heater 102 and a cooler 104. Engine 100 has two pistons, a hot piston 106 and a cold piston 108 within cylinders 110 and 112 respectively. Cylinders 110, 112 contain a working gas which (like all gases) expands when heated and compresses when cooled. Cylinders 110, 112 are connected a regeneration area 114 which is used to store heat energy during one part of the Stirling cycle and return it to the working gas 116 in another part of the cycle.

According to the ideal gas law, $PV=nRT$, where P is pressure, V is volume, n is the number of moles of gas, R is a gas constant and T is temperature. So temperature is proportional to pressure time volumes. Hence, when a gas is heated it expands if possible, and otherwise the pressure increases.

The Stirling cycle has four phases, Isothermal Compression, Constant Volume Heating, Isothermal Expansion, and Constant Volume Cooling (these phases are somewhat simplified for this explanation). Isothermal Compression occurs as heat is transferred from the hot gas 116 to a cold sink, and the gas compresses, drawing piston 108 up from its full capacity. In the present case, the heat is removed by cooler 104, perhaps by simply conducting the heat away from the engine. Some heat is also stored in the regenerator 114 (which might be a network of wires or the like).

Once cold piston 108 is in its intermediate position, the Constant Volume Heating phase begins. Cold piston 108 moves up to its minimum capacity position and then hot piston 106 moves down to an intermediate position. Gas 116 hence passes through regenerator 114 and is heated. Since volume remains the same and the temperature of the gas increases, pressure goes up.

In the third phase, Isothermal Expansion, heater 102 heats the gas. It expands and moves hot piston 106 down to its full capacity position. In the Constant Volume Heating phase, hot piston 106 moves up to its minimum capacity position and then cold piston 108 moves down to its minimum capacity position, again passing gas 116 through regenerator 114. Heat is passed from the gas to the regenerator, so its pressure and volume both remain constant.

Practical Stirling engines have been built. For example, some submarines use Stirling engines. A recent example of a Stirling engine is described in U.S. patent application Ser. No. 6,062,023 to Kerwin et al. Known Stirling engines generally require an extremely hot heat source (600 to 800 degrees Celsius) and a temperature gradient of at least 400° C. The gases used in these engines, for example Nitrogen and Carbon Dioxide are in the gas phase at all times. Thus, current Stirling engines operate at impractically high temperatures and do not take advantage of the liquid phase of the working gas.

A need remains in the art for improved heat engines that operate at more practical temperatures, do not require extreme heat gradients, and utilize the liquid phase of the refrigerant.

SUMMARY OF THE INVENTION

It is an object of the present invention to provide an improved heat engine.

The heat engine of the present invention operates at practical temperatures and utilizes the liquid phase of the refrigerant. It does not require extreme heat gradients. In addition, the structure of the present heat engine is an improvement.

A heat engine according to the present invention utilizes a liquid refrigerant and a hot thermal fluid to convert heat into mechanical work. The heat engine comprises (1) an expansion chamber having a piston disposed to execute strokes within a cylinder and a thermal fluid jacket containing the hot thermal fluid and disposed around the cylinder, wherein the expansion chamber heats the liquid refrigerant via heat transfer from the hot thermal fluid in the thermal fluid jacket and allows the refrigerant to expand, the expansion causing the piston to execute strokes and thereby generate work, (2) a dynamic throttling valve for injecting liquid refrigerant into the cylinder adjacent to the piston, wherein the valve injects a minimal flow of liquid refrigerant at the beginning of the piston stroke and a maximal flow as the piston stroke continues, (3) a pressure injector for injecting the liquid refrigerant into dynamic throttling valve under pressure, (4) a compressor for compressing the expanded gas refrigerant from the expansion chamber, and (5) a condenser for returning the compressed gas refrigerant from the compressor to a liquid state for use by the pressure injector.

The thermal fluid might be hot water.

In one preferred embodiment, two expansion chambers are used, and the piston in the second expansion chamber reciprocates with respect to the first. As a feature, the pressure injector includes a magnetically assisted hydraulic element having two paths for the refrigerant with an input three way switch and an output three way switch to channel the refrigerant through paths and increase pressure.

The dynamic throttling valve may comprise a tapered pin at the end of the piston fitting into a tapered opening in the injector and a concave area on the piston surrounding the pin for allowing the minimal flow of refrigerant at the beginning of the stroke.

The fluid jacket preferably includes heat transfer bars and heat transfer rings to increase turbulent flow and maximize heat transfer. The heat transfer bars also extend into the cylinder to transfer heat to the refrigerant. Heat transfer fins extend from the fluid jacket into the cylinder to transfer heat to the refrigerant.

Input hot fluid inlet tubes inject the hot fluid into the fluid jacket and cold fluid outlet tubes remove the cold fluid from the jacket after it has warmed the refrigerant.

Preferably the heat transfer rings are toothed and the fluid passes through the teeth in a turbulent manner. The teeth on a ring are offset from teeth on an adjacent ring. Heat transfer bars pass through teeth on one or more rings. Also, heat transfer bars pass between the heat transfer fins.

DETAILED DESCRIPTION OF THE PREFERRED EMBODIMENTS

A listing of parts and reference numbers is helpful in understanding the present invention.

| Ref. No | Part |
|---|---|
| 1 | Ceramic holder |
| 2 | Ceramic insert |
| 3 | Injector body (jet) |
| 4 | Pressure plate outer ring |
| 5 | Pressure plate inner ring |
| 6 | Slip seal |
| 7 | Outer ring cap |
| 8 | Ring seal support |
| 9 | Top ring seal |
| 10 | Slide ring |
| 11 | Inner ring cap |
| 12 | Inner ring O-ring seal |
| 13 | Ring six flat seal |
| 14 | Inner cylinder jet seal A |
| 15 | Inner cylinder jet seal B |
| 16 | Inner cylinder jet |
| 17 | Ring 5 seal |
| 18 | Ring 2 seal |
| 19 | Cylinder main body |
| 20 | Gas exhaust ports (exhaust valves) |
| 21 | Heat transfer bars (thermal conducting rods) |
| 22 | Heat transfer rings |
| 23 | Heat cylinder fins |
| 24 | Heat cylinder |
| 25 | Hot fluid inlet tubes |
| 26 | Cold fluid outlet tubes |
| 27 | Fluid jacket |
| 28 | Cylinder lower ring seal |
| 29 | Cylinder lower rings |
| 30 | Piston seal |
| 31 | Piston |

-continued

| Ref. No | Part |
|---|---|
| 32 | Piston lower seal capture ring |
| 33 | Piston pin (needle valve pin) |
| 34 | Piston connecting rod |
| 35 | Drive linkage |
| 36 | Concave area |
| 100 | Conventional Stirling engine |
| 102 | Heat source |
| 104 | Cold source |
| 106 | Hot piston |
| 108 | Cold piston |
| 110 | Cylinder |
| 112 | Cylinder |
| 114 | Regenerator |
| 116 | Working gas |
| 200 | Heat engine |
| 202 | Reciprocating expansion chamber |
| 204 | Compressor |
| 206 | Condenser |
| 208 | High pressure injector |
| 210 | Refrigerant |
| 211 | Liquid refrigerant |
| 212 | Hot fluid |
| 214 | Work output |
| 216 | Cold fluid |
| 218 | Low pressure hot gas refrigerant |
| 220 | High pressure hot gas refrigerant |
| 302 | Input switch |
| 304 | Output switch |
| 306 | Coil |
| 308 | Coil |
| 310 | Magnet |
| 312 | Control block |
| 314 | Magnetic sleeves |
| 316 | One-way flow restrictor |

Note that the term "refrigerant" is used herein to designate not only traditional refrigerants such as R410-A, freon and the like, but also any suitable substance that has a cooling effect when converted from a liquid state to a gas state.

Figure 1:
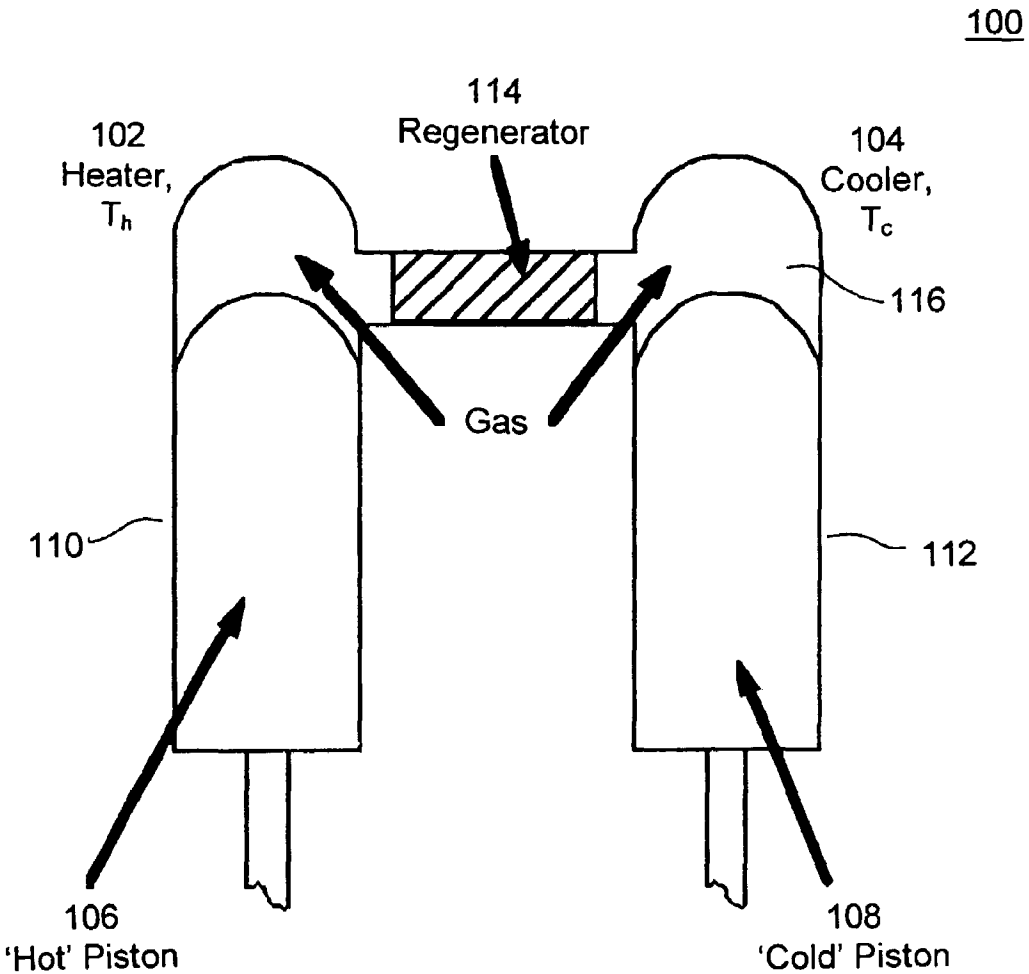
Figure 1 (Prior Art)
FIG. 1 (prior art) is a schematic drawing showing a conventional Stirling engine.
Figure 2:
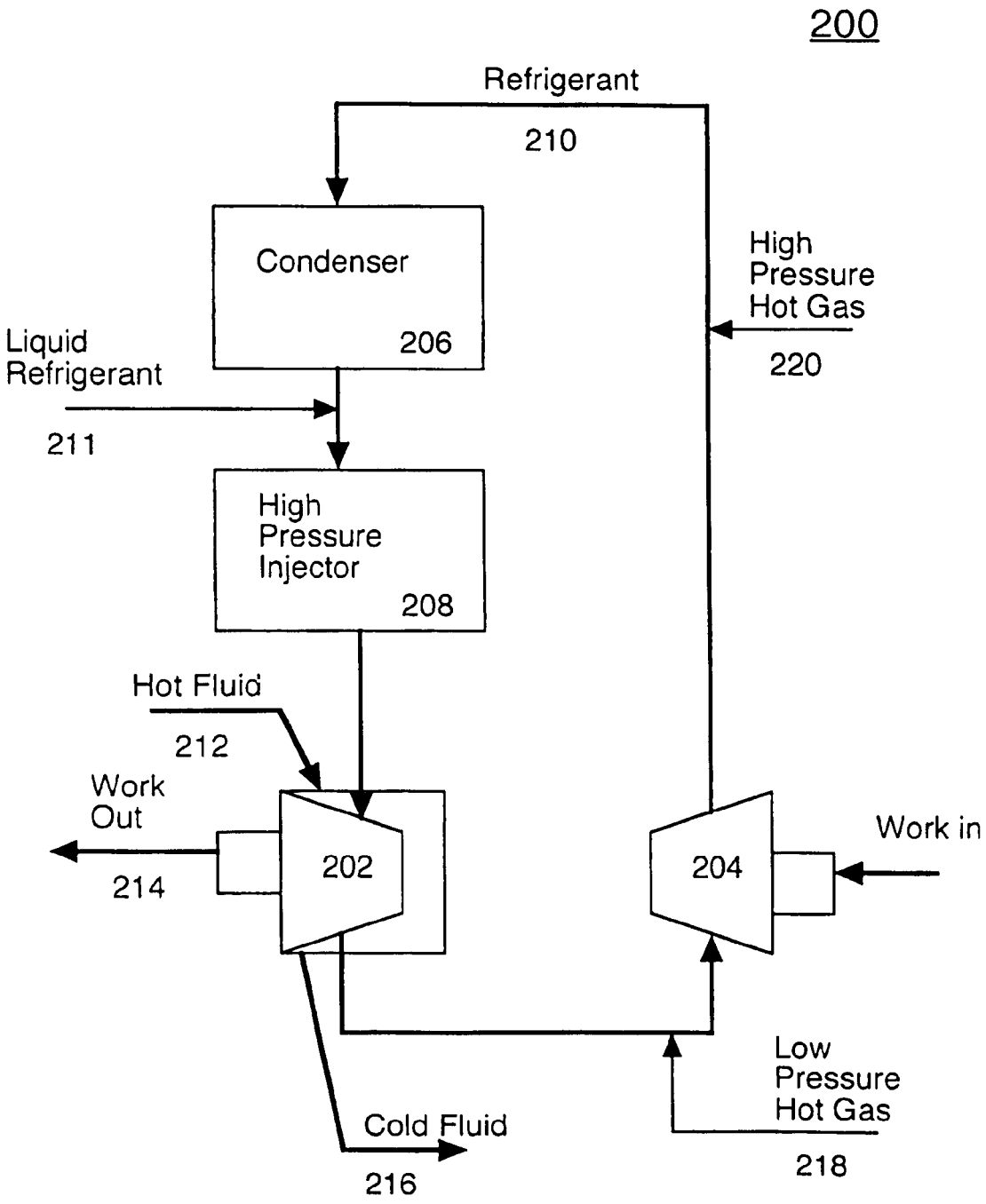
FIG. 2 is a block diagram illustrating the heat engine of the present invention.
Figure 4:
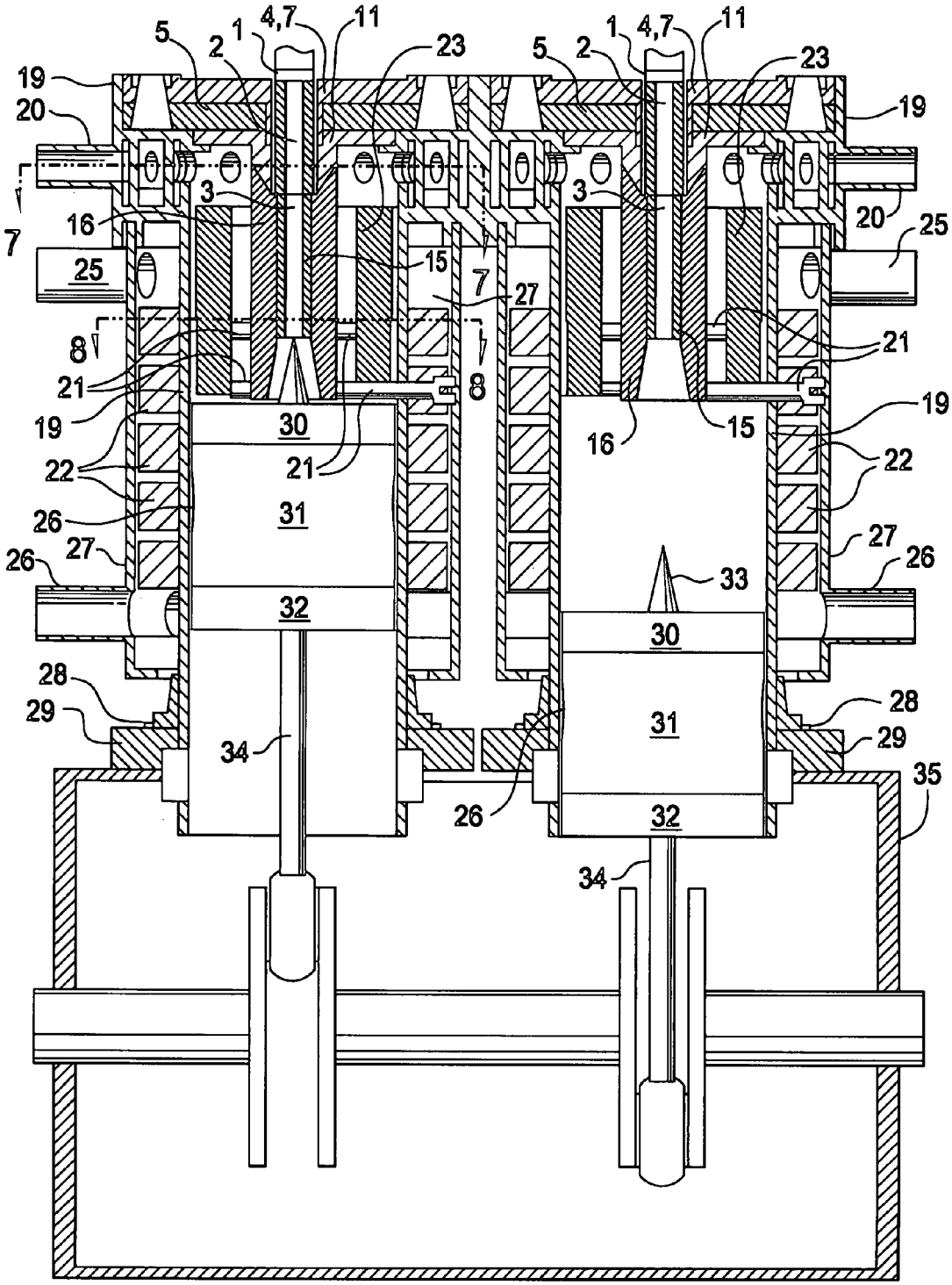
FIG. 4 is a cutaway schematic diagram illustrating a preferred embodiment of the cylinder portion of the heat engine of FIG. 2.
Figure 5:
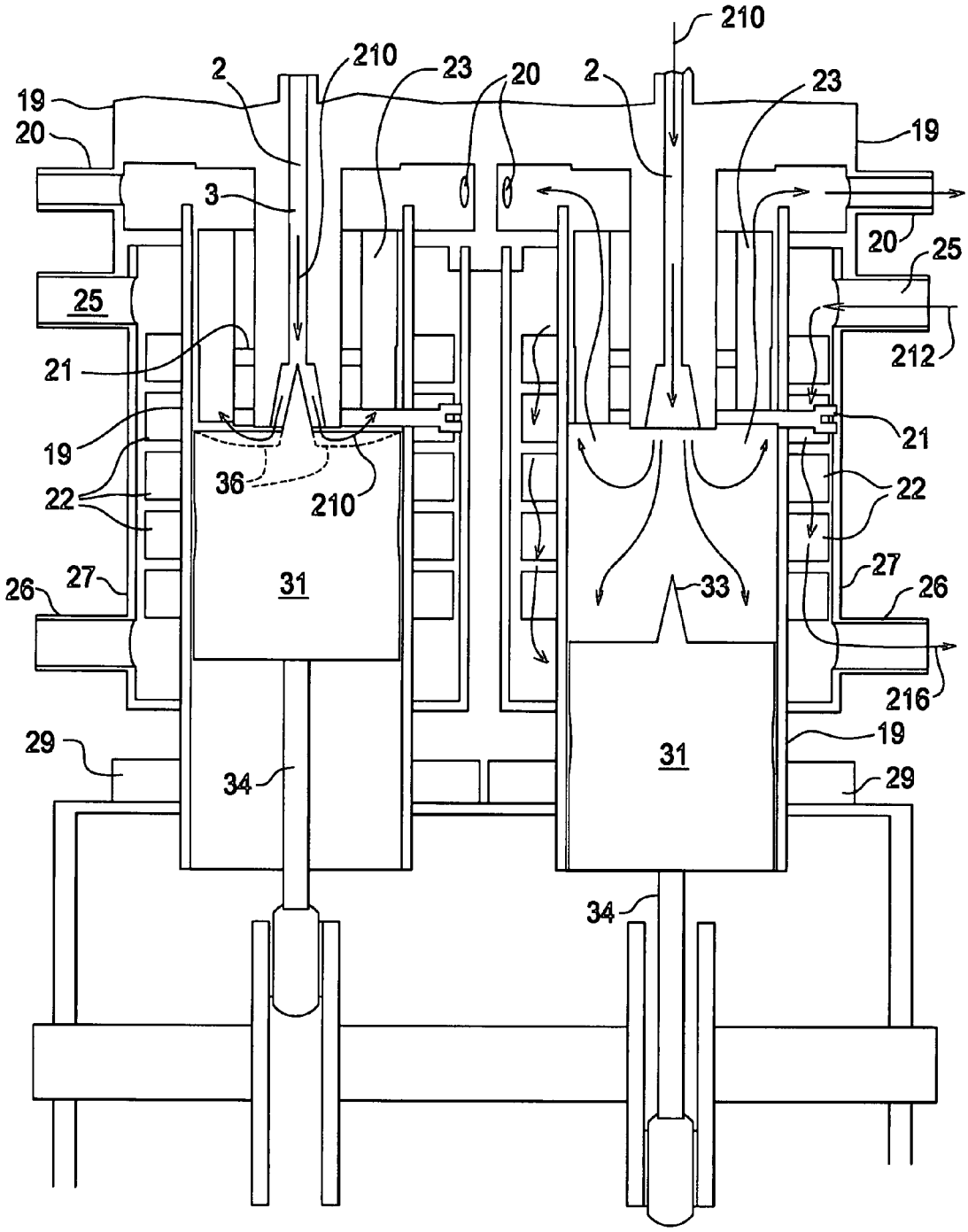
FIG. 5 is a simplified schematic diagram of the cylinder portion of FIG. 4 showing the path of working gas and warming liquid in the engine.
Figure 6:
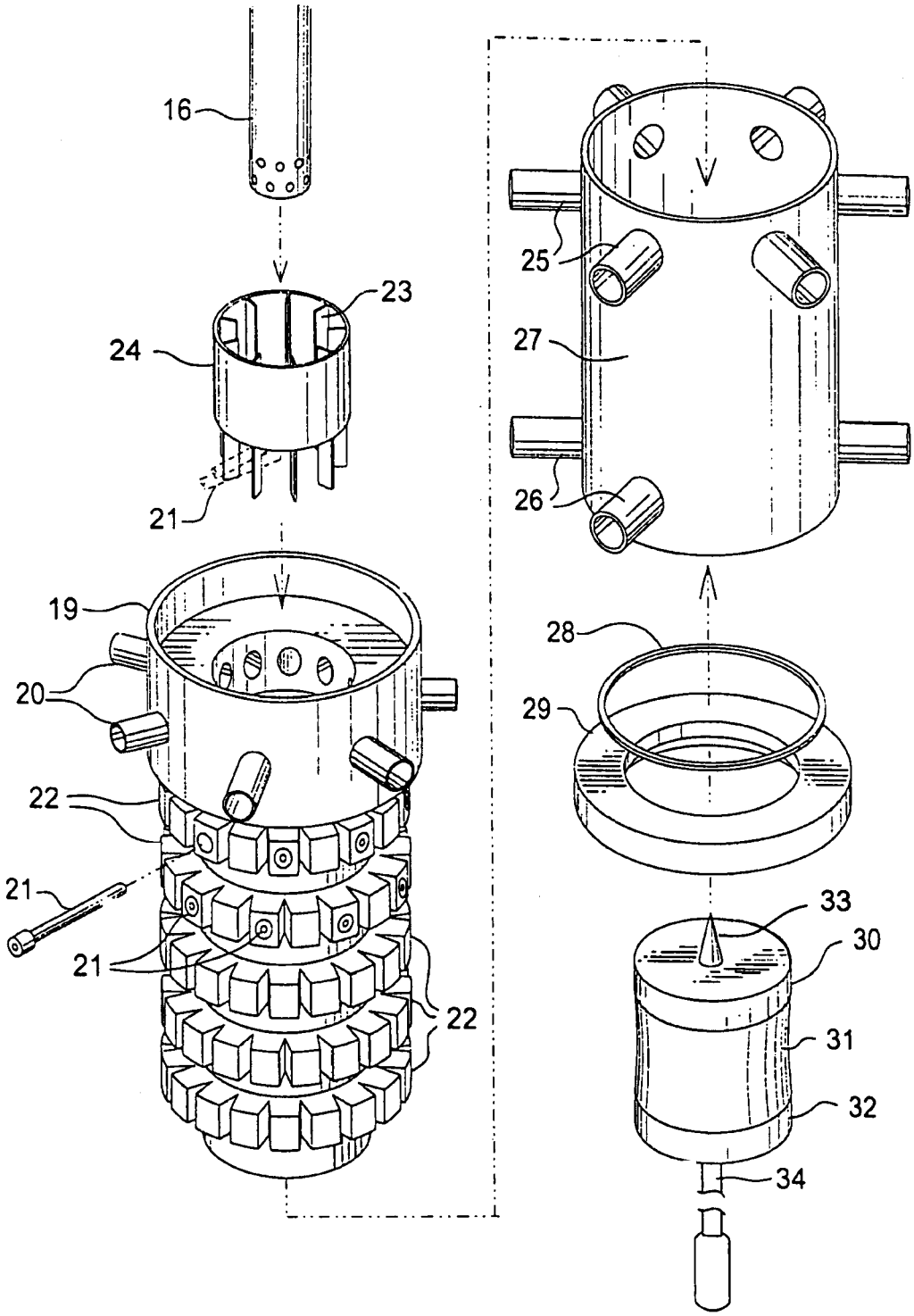
FIG. 6 is an exploded isometric view of the cylinder portion of FIG. 4.
Figure 7:
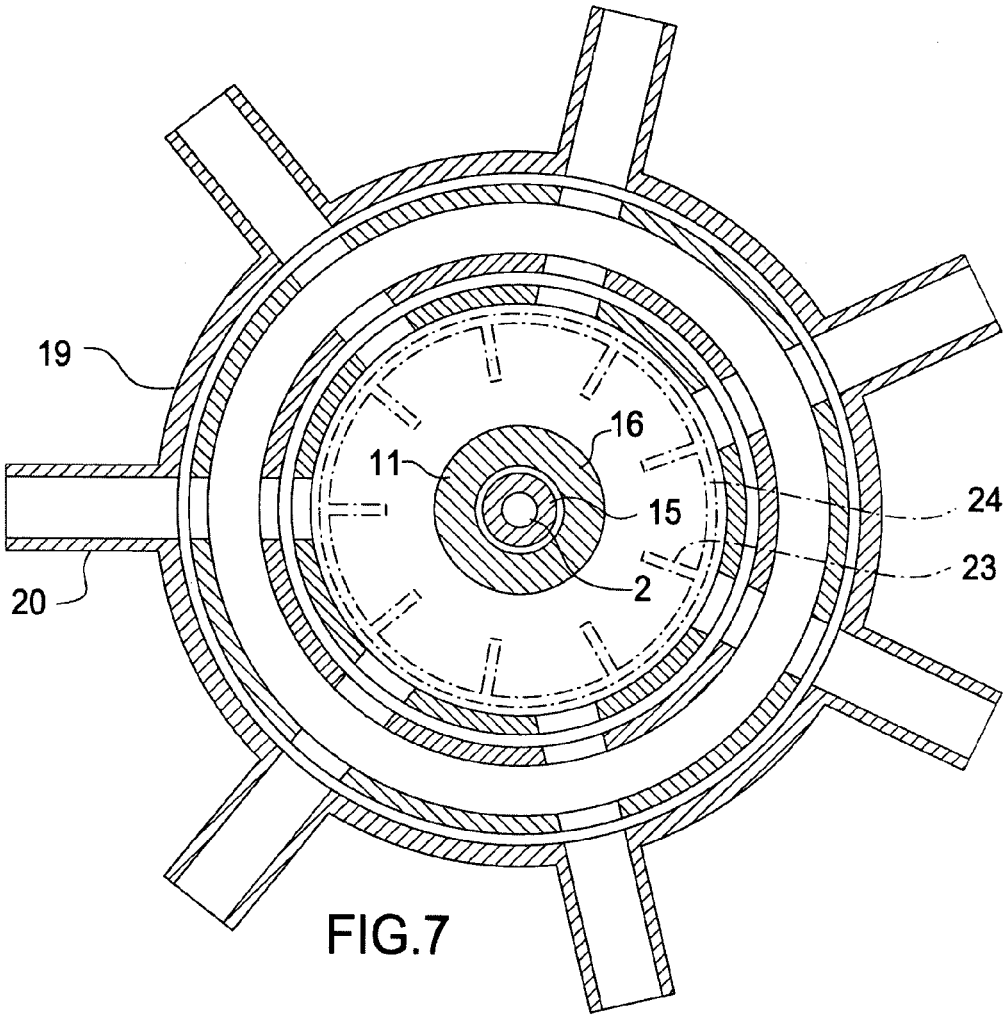
FIG. 7 is a top cutaway view along section line AA of FIG. 6.
Figure 8:
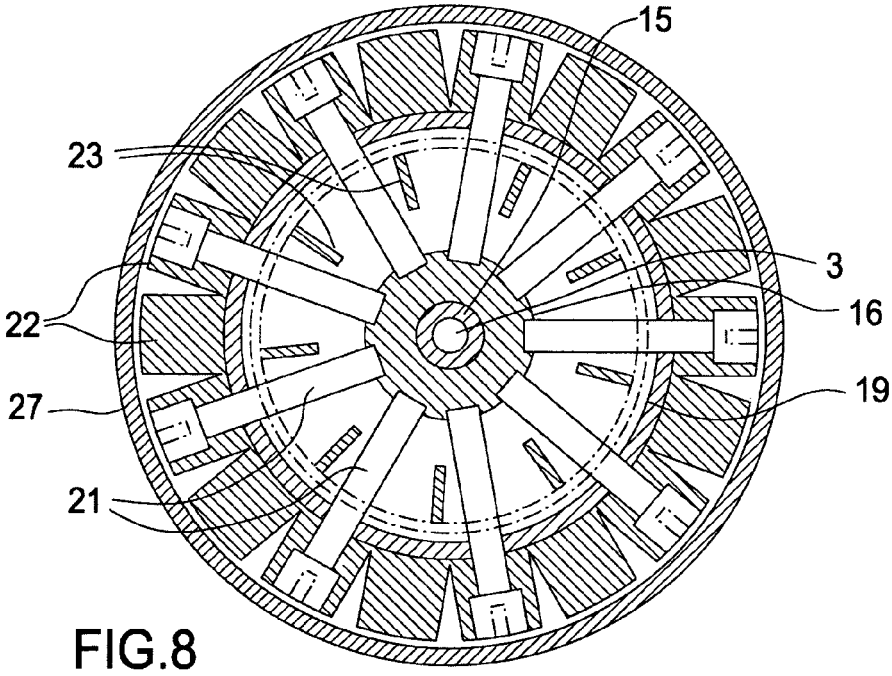
FIG. 8 is a top cutaway view along section BB of FIG. 6.

FIG. 2 is a block diagram that illustrates the entire heat engine assembly 200. It shows the cycling of refrigerant 210 and fluid 212. 216. FIGS. 4 and 5 illustrate reciprocating expansion chamber 202 in detail. FIGS. 6 through 8 show the details of one cylinder assembly.

FIG. 2 is a block diagram illustrating one embodiment of heat engine 200 of the present invention. Refer also to FIGS. 4 through 8 for more detailed views of reciprocating expansion chamber 202. A controlled mass of condensed refrigerant 210 is injected rapidly by a magnetically assisted hydraulic high pressure dynamic valve piston and injector 208 into reciprocating expansion chamber 202. As shown in the left hand cylinder diagram in FIG. 5, a small amount of liquid refrigerant 211 trickles out of jet 3 and up into heat cylinder fins 23 and heat cylinder bars 21. These are warmed by hot fluid 212, and so liquid refrigerant 211 quickly warms and becomes a gas. As refrigerant 210 expands, it pushes piston 31 down. See the right hand cylinder diagram in FIG. 5. This allows more liquid refrigerant 211 to exit jet 3 and expand into a gas. As the refrigerant is heated and expanded, the piston in the cylinder fully extends. The exhaust valves then open, and as the second cylinder enters its power stroke, it pushes the vaporized refrigerant 218 into the suction line of compressor 204. The compressor increases the pressure of the vaporized refrigerant and then sends it to condenser 206, where the refrigerant is reconstituted into a liquid ready for another cycle.

The heart of heat engine 200 is reciprocating expansion chamber 202, which converts heat from hot fluid 212 into mechanical work 214. Reciprocating expansion chamber 202 is shown in more detail in FIGS. 4 through 8. Chamber 202 utilizes a refrigerant 210 such as R410-A or R134 (freon or the like) in a liquid state 211. High pressure injector 208 (shown in more detail in FIG. 3) injects refrigerant 210 into chamber 202 under enough pressure to keep refrigerant 210 in a liquid state until it is desirable to have refrigerant 210 expand into a gas. The expansion of refrigerant 210 into a gas assists chamber 202 in generating mechanical work 214. Hot fluid 212 is the heat source for chamber 202 and cold fluid 216 is an output. Another output is refrigerant 210, now a hot, low pressure gas 218. Compressor 204 pressurizes refrigerant 210, forming a hot, high pressure gas 220, and condenser 206 generates liquid refrigerant again.

One very beneficial use of heat engine 200 is in the internal combustion engine of a car (not shown). Hot fluid (for example hot water) 212 can be generated by the car engine, and cold fluid 216 may in turn be used to cool the engine. Hence, the only extra element the engine needs to provide is the work to compress and condense refrigerant 210. As refrigerant 210 is preferably R410-A or the like, this is easily achieved.

Figure 3:
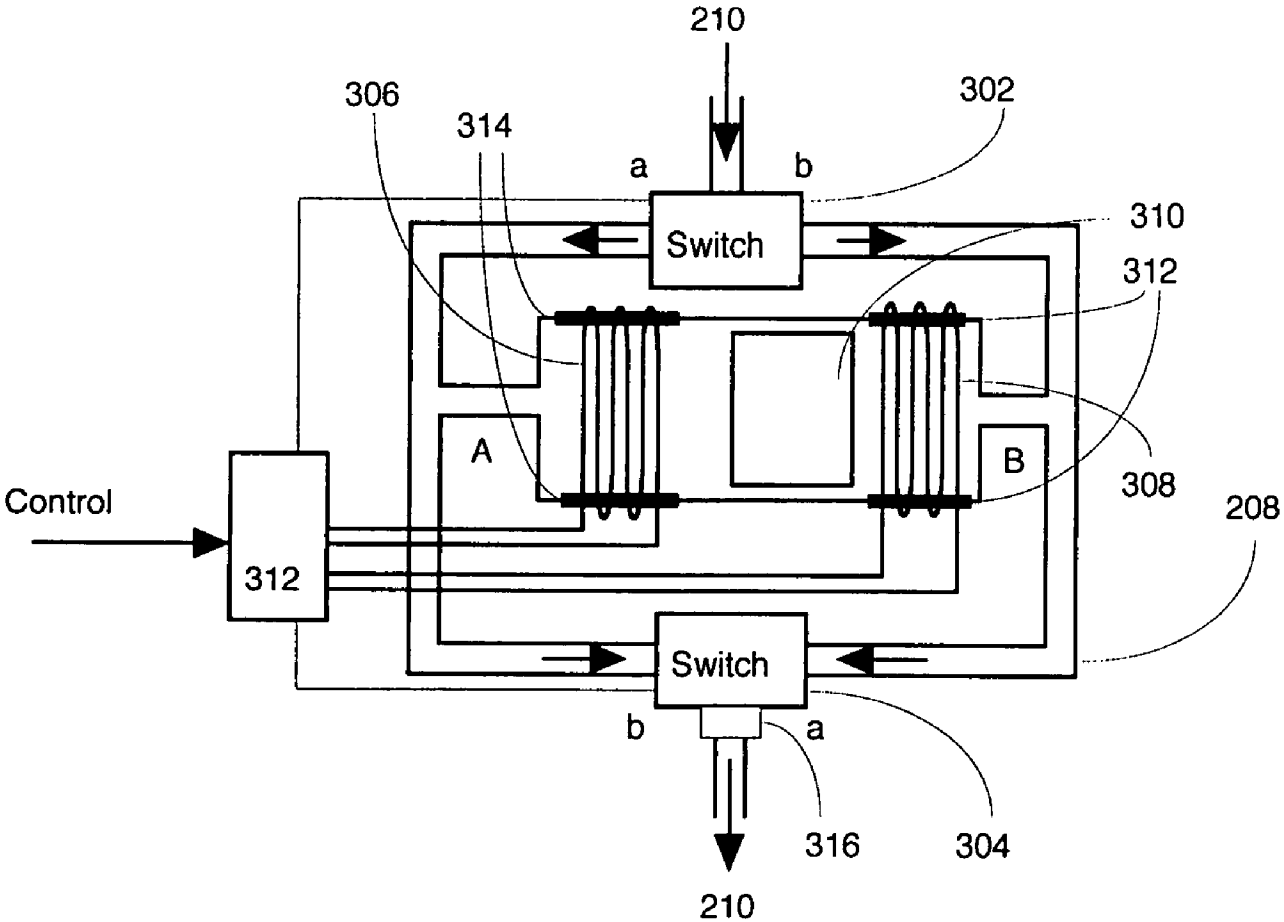
FIG. 3 is a block diagram illustrating the pressure injector of FIG. 2.

FIG. 3 is a block diagram illustrating a preferred embodiment of pressure injector 208 of FIG. 2. A controlled mass of condensed refrigerant 210 is injected rapidly by magnetically assisted hydraulic high pressure injector 208 into a cylinder 31. Refrigerant 210 enters 3-way switch 302. It exits switch 304 via one-way flow restrictor 316. Control block 312 controls switches 302, 304 according to the following table.

TABLE 1

| Function | Flow Direction | Switch 302 Direction | Switch 304 Direction |
|---|---|---|---|
| Pressure Assist | A | a | a |
| Pressure Assist | B | b | b |
| Bypass | B | a | b |
| Bypass | A | b | a |

The purpose of the magnetic assist on the high pressure injector is to increase the fluid injection pressure and rate of injection of the fluid into the cylinder. Increasing the fluid pressure helps to ensure that the refrigerant remains a liquid as it is injected, and increasing the rate of injection increases the work done by the engine. Increasing or decreasing the power to the magnetic assist also provides a throttling function.

In use, core 310 is alternatively pulled toward coil 306 and coil 308. When core 310 moves towards coil 306, it increases the pressure in branch A of the injector. When core 310 moves towards coil 308, it increases the pressure in branch B of the injector. Control block 312 energizes coil 306 to attract core 310 when switch a and b are open. Hence, control block 312 energizes coil 308 to attract core 310 when switch 302*a* and switch 304*b* are open. Control block 312 energizes coil 306 to attract core 310 when switch 302*b* and switch 304*a* are open.

FIG. 4 is a cutaway schematic diagram illustrating a preferred embodiment of the reciprocating expansion chamber 214 of heat engine 200 of FIG. 2. FIG. 5 is a simplified version of FIG. 4 designed to show the flow of refrigerant and hot fluid within chamber 214. In the specific embodiment of FIGS. 4 and 5, two pistons 31 are used, though other configurations using a different number of pistons are also possible. The two pistons 31 are connected via a drive linkage 35 such that as one piston goes up, the other goes down. Piston connecting rods 34 connect pistons 30 to the drive linkage. Pistons 31 operate within cylinder main bodies 19.

In the heat engine of the present invention, heat is transferred to a working gas, or refrigerant, via conduction through the cylinder head and walls. The present invention is structured to maximize the heat transfer. The preferred embodiment of FIGS. 4-8 includes heat transfer fins 23, bars 21 and rings 22 in contact with hot liquid 212 that is in turbulent flow across the heat transfer elements. Another feature of the present invention is a configuration designed to cause the refrigerant to expand rapidly while it is heated. The gas injection system incorporates an internal dynamic throttle valve composed of the cylinder's thermally insulated input jet 3 and a needle valve pin 33 on the piston 31. A controlled mass of condensed refrigerant 210 is injected rapidly by a magnetically assisted hydraulic high pressure injector 208 into a cylinder 24.

Equation for heat transfer due to conduction:

$$Q/t-kA(T_{hot}-T_{cold_x})/d$$

Where:

Q=heat transferred in time=t k=thermal conductivity of the conductor

A=area

T=temperature d=thickness of conductor $T_{hot}$=temperature of the outer surface of tabbed heat ring internal to fluid transport jacket $T_{cold_x}$=temperature of the internal surface of expansion cylinder, finned heat ring, and outer surface of internal jet Equations for heat transfer due to forced convection:

$$Q=hA(T_S-T_\infty)$$

Where:

Q=Loss of Thermal energy h=Heat transfer coefficient $T_S$=Surface temperature $T_\infty$=Fluid ambient temperature A=Area of heat element The relationship for the forced convection heat transfer coefficient (h) for a cylinder in cross-flow follows a non-dimensional correlation.

$$N_{NU}=C*(Re)^m*(Pr)^n$$

Where:

$N_{NU}$=Nusselt number=(hd)/κ

C=Constant

Pr=Prandtl number=(ρVd)/μ m=Coefficient n=Coefficient h=Heat transfer coefficient d=Sensor diameter

κ=Thermal conductivity of fluid

μ=Fluid viscosity

Cp=Specific heat of the fluid

ρ=Fluid density

V=Fluid velocity

ρV=Mass velocity

The Prandtl number for gases is approximately 0.7 and does not vary much with temperature so it is generally dropped from the equations. The heat transfer coefficient (h) is:

$$h=(C\kappa/d)*(\rho Vd/\mu)^m$$

In order to initially keep the refrigerant in a liquid state as it is being injected, the refrigerant is injected into a high pressure and thermally isolated chamber 2. Refer to the left hand cylinder diagram in FIG. 5 as an illustration of the beginning of the cylinder stroke and the right hand diagram for the end of the cylinder stroke. As the refrigerant is injected into the cylinder's input jet chamber maximum back pressure is developed, creating a high pressure region. Incorporated into the cylinder's input jet is a ceramic or thermally isolating polymer insert thermally isolating the refrigerant from the high temperature of the expansion chamber. With the piston at the beginning of its stroke (left hand diagram in FIG. 5) a limited amount of liquid refrigerant 211 flows out of jet 3 and comes in contact with the heat fins 23 and thermal conducting rods 21 that pass heat from the external hot fluid 212 in the fluid jacket 27 that has been designed for maximum turbulent flow to produce maximum heat conduction to the input jet. The refrigerant boils and high pressure develops. This developing pressure produces a directed force against piston 31, causing the piston to move. As the piston moves, the throttle valve opens, causing an increase in volume at the input jet. As a result, the refrigerant expansion rate rapidly increases.

As the refrigerant continues to be heated, the pressure reaches its maximum, and then decreases in proportion to the increasing volume caused by the piston extending. Thus, the pressure is reduced by the time the piston is fully extended. See the right hand cylinder diagram in FIG. 5. The exhaust valves 20 then open, and as the second cylinder enters its power stroke, it pushes the vaporizes refrigerant into the suction line of the compressor 214.

In operation, refrigerant 210 enters injector 3 from high pressure injector 208 (see FIG. 2). Ceramic holder 1 and ceramic insert 2 act as thermal isolation. As piston 31 moves downward, Pin 33 retracts from inner cylinder jet 16 and refrigerant 210 is able to enter cylinder 19. Hot fluid 212 heats up refrigerant 210 and converts it from a fluid into a gas. Refrigerant 210 continues to expand as piston 31 moves down, and hence converts into a gas more quickly. As refrigerant 210 expends, it forces piston 31 to move the rest of the way down, and this is the portion of the cycle that provides mechanical work. Hot fluid 212 warms refrigerant 210 as follows. Hot fluid 212 enters fluid jacket 27 via hot fluid inlet tubes 25. Hot fluid 212 circulates through and around heat transfer bars 21 and heat transfer rings 22. As heat from hot fluid 212 is conducted into the expansion chamber and warms refrigerant 210, the heat loss from hot fluid 212 turns hot fluid 212 into cold fluid 216, and exits via cold fluid outlet tubes 26. In addition, cylinder 24 includes heat fins 23 which also assist in quickly heating up refrigerant 210.

As piston 31 moves back upward, the vaporized compound gas refrigerant 210, now in its low pressure, hot gas phase 218, exits gas exhaust ports 20.

Returning to FIG. 4, the preferred embodiment of reciprocating expansion chamber 202 will now be described in more detail.

FIG. 6 is an exploded isometric view of the cylinder assembly portion of FIG. 4. This view better shows fins 23 of cylinder 24, as well as heat transfer bars 21 and heat transfer rings 22 on the exterior of cylinder 19 and inside of fluid jacket 27. Note that rings 22 are preferably toothed or crenulated as shown in FIG. 6, in order to allow fluid 212 to circulate around and among the teeth in a turbulent manner. The teeth on each ring are preferably offset from the teeth on an adjacent ring.

This figure also shows the locations and spacing of gas exhaust ports 20, hot fluid inlet tubes 25, and cold fluid outlet tubes 26. Cylinder lower ring 29 and cylinder lower ring seal 28 are positions at the bottom of water jacket 27. Piston 31 comprises piston pin 33, piston seal 30, piston lower seal capture ring 32, and piston connecting rod 34. When the cylinder assembly is put together, jet 16 is inside of cylinder 24, which is inside the top portion of cylinder body 19. Water jacket 27 is outside of cylinder body 19. Piston 31 is inside cylinder body 19, with pin 33 fitted to the inside of jet 16 when the piston is in the uppermost position.

FIG. 7 is a top cutaway view along section line 7-7 of FIG. 4. This view shows gas exhaust ports 20, a section of jet 16, with its ceramic insert 2, jet seal 15 and inner ring cap 11. Cylinder 24 and its fins 23 are below section 7-7.

FIG. 8 is a top cutaway view along section 8-8 of FIG. 6. At this level, water jacket 27 is intersected and a set of heat transfer bars 21 are seen along with a set of heat transfer rings 22. Fins 24 are also seen, interspersed with bars 21.

Those skilled in the art will appreciate that various modifications to the exemplary embodiments are within the scope of the patent.

What is claimed is:

1. A heat engine which utilizes a liquid refrigerant and a hot thermal fluid to convert heat into mechanical work, the heat engine comprising:

an expansion chamber having a piston disposed to execute strokes within a cylinder and a thermal fluid jacket containing the hot thermal fluid and disposed around the cylinder, wherein the expansion chamber heats the liquid refrigerant via heat transfer from the hot thermal fluid in the thermal fluid jacket and allows the refrigerant to expand, the expansion causing the piston to execute strokes and thereby generate work;

a dynamic throttling valve for injecting liquid refrigerant into the cylinder adjacent to the piston, wherein the valve injects a minimal flow of liquid refrigerant at the beginning of the piston stroke and a maximal flow as the piston stroke continues;

a pressure injector for injecting the liquid refrigerant into dynamic throttling valve under pressure;

a compressor for compressing the expanded gas refrigerant from the expansion chamber; and a condenser for returning the compressed gas refrigerant from the compressor to a liquid state for use by the pressure injector.

2. The heat engine of claim 1 wherein the thermal fluid is hot water.

3. The heat engine of claim 1, further comprising a second expansion chamber, the piston in the second expansion chamber constructed and arranged to reciprocate with respect to the first.

4. The heat engine of claim 1 wherein the pressure injector comprises a magnetically assisted hydraulic element and includes two paths for the refrigerant with an input three way switch and an output three way switch to channel the refrigerant through paths and increase pressure.

5. The heat engine of claim 1 wherein the fluid jacket includes heat transfer bars and heat transfer rings to increase turbulent flow and maximize heat transfer.

6. The heat engine of claim 5 wherein the heat transfer bars also extend into the cylinder to transfer heat to the refrigerant.

7. The heat engine of claim 6, further including heat transfer fins extending from the fluid jacket into the cylinder to transfer heat to the refrigerant.

8. The heat engine of claim 1 wherein the dynamic throttling valve comprises a tapered pin at the end of the piston fitting into a tapered opening in the injector and a concave area on the piston surrounding the pin for allowing the minimal flow of refrigerant at the beginning of the stroke.

9. The heat engine of claim 1 further including input hot fluid inlet tubes for injecting the hot fluid into the fluid jacket and cold fluid outlet tubes for removing the cold fluid from the jacket after it has warmed the refrigerant.

10. A dynamic throttling valve for use with a piston and cylinder comprising:

an injector for injecting liquid refrigerant into the cylinder adjacent to an end of the piston, the injector having a tapered opening;

a tapered pin at the end of the piston fitting into the tapered opening in the injector; and a concave area formed on the piston surrounding the pin for allowing a minimal flow of refrigerant at the beginning of a piston stroke;

wherein the valve injects a minimal flow of liquid refrigerant at the beginning of the piston stroke and a maximal flow as the piston stroke continues.

11. The valve of claim 10 joined to a high pressure injector.

12. The valve of claim 10 wherein the refrigerant expands into a gas in the cylinder and further including a compressor and condenser to return the refrigerant to a liquid state for reuse.

13. The valve of claim 12 further including a conduction and forced convection element for heating the refrigerant in the cylinder.

14. A heat transfer system for use with a piston and cylinder comprising:

a thermal fluid jacket containing a hot thermal fluid and disposed around the cylinder;

heat transfer bars and heat transfer rings within the fluid jacket to increase turbulent flow of the thermal liquid;

the heat transfer bars extending into the cylinder to conduct heat into the cylinder; and heat transfer fins extending from the fluid jacket into the cylinder to convect heat into the cylinder.

15. The heat transfer system of claim 14 further including a working gas in the cylinder which is warmed by the transferred heat.

16. The heat transfer system of claim 15 wherein the refrigerant is converted from a liquid form to a gas form by the transferred heat and expansion.

17. The heat transfer system of claim 14 wherein the heat transfer rings are toothed and the fluid passes through the teeth in a turbulent manner.

18. The heat transfer system of claim 17 wherein the teeth on a ring are offset from teeth on an adjacent ring.

19. The heat transfer system of claim 17 wherein heat transfer bars pass through teeth on one or more rings.

20. The heat transfer system of claim 14 wherein heat transfer bars pass between the heat transfer fins.

* * * * *

UNITED STATES PATENT AND TRADEMARK OFFICE

CERTIFICATE OF CORRECTION

PATENT NO. : 7,296,408 B2
APPLICATION NO. : 10/946228
DATED : November 20, 2007
INVENTOR(S) : Michael R. Pierce It is certified that error appears in the above-identified patent and that said Letters Patent is hereby corrected as shown below:

Column 1, Line 45, delete “time volumes” and insert --times volume--.

Column 4, Line 40, delete “212. 216” and insert --212, 216--.

Column 7, Line 30, delete “vaporizes” and insert --vaporized--.

Column 7, Line 40, delete “expends” and insert --expands--.

Signed and Sealed this

Twentieth Day of May, 2008

JON W. DUDAS
*Director of the United States Patent and Trademark Office*